US005127546A

United States Patent [19]

Chen

[11] Patent Number: 5,127,546

[45] Date of Patent: Jul. 7, 1992

[54] STORAGE BIN STRUCTURE FOR AN AUTOMATIC VENDING MACHINE

[76] Inventor: Ming-Ho Chen, No. 166, Fu-Hsing Rd., Hsin-Ying City, Tainan Hsien, Taiwan

[21] Appl. No.: 742,850

[22] Filed: Aug. 8, 1991

[51] Int. Cl.[5] ..... G07F 11/16

[52] U.S. Cl. ..... 221/242; 221/203; 221/253; 221/258

[58] Field of Search ..... 271/35; 414/797.6; 221/241, 242, 44, 218, 253, 254, 258, 202, 203, 277

[56] References Cited

U.S. PATENT DOCUMENTS

| | | | |
|---|---|---|---|
| 1,886,378 | 11/1932 | Dearsley | 221/277 |
| 3,086,772 | 4/1963 | Vogel | 271/35 |
| 3,145,066 | 8/1964 | O'Neal | 221/242 |
| 4,000,821 | 1/1977 | Naito et al. | 414/797.6 |
| 4,915,369 | 4/1990 | Rutishauser | 271/35 |
| 5,046,641 | 9/1991 | Gray | 221/253 |

FOREIGN PATENT DOCUMENTS

| | | | |
|---|---|---|---|
| 2644857 | 4/1978 | Fed. Rep. of Germany | 221/242 |
| 185746 | 8/1988 | Japan | 271/35 |

*Primary Examiner*—H. Grant Skaggs
*Attorney, Agent, or Firm*—Baker & Daniels

[57] ABSTRACT

A storage bin structure is used for superposed articles in an automatic vending machine and includes a front wall unit which can be moved to vary the volume of the storage space for the articles to be mold. A conveyer unit includes two motor-activated circular front wheels and two elliptical rear wheels. Two endless conveyer belts run around the front wheels and the rear wheels. When the belts are idle, the upper ends of the rear wheels are below those of the front wheels so as to prevent the lowermost one of the superposed articles from forward movement. When the belts circulate in response to entry of coin or coins, the rear wheels rotate so that the upper ends of the rear wheels are higher than those of the front wheels, thereby moving the articles forward.

6 Claims, 9 Drawing Sheets

STORAGE BIN STRUCTURE FOR AN AUTOMATIC VENDING MACHINE

BACKGROUND OF THE INVENTION

1. Field of the Invention

This invention relates to a storage bin structure for superposed articles in an automatic vending machine, more particularly to a storage bin structure in which it is easy to vary the length of the storage space for the articles and to move the articles.

2. Description of the Related Art

The improvement of this invention is directed to a conventional storage bin structure for superposed articles to be sold in an automatic vending machine, which is shown in FIGS. 1, 2 and 3. As illustrated, the conventional storage bin structure consists of a wall assembly 1 and a conveyer unit 2. The wall assembly 1 includes an upright support plate (D), two side wall units 11, 12, a front wall unit 13, a top wall unit 14, a bottom wall unit 15, and a rear wall unit 16. The support plate (D) is fixed in the machine and has two horizontal rows of holes (D1) so as to screw the side wall units 11, 12, the top wall unit 14 and the bottom wall unit 15 thereto. The front wall unit 13 is screwed to the side wall units 11, 12. The top wall unit 14 and the bottom wall unit 15 have lengthwise slide slots 141, 151 formed therethrough so as to connect slidably the rear wall unit 16 thereto. The rear wall unit 16 is locked on the top wall unit 14 and the bottom wall unit 15 by lock bolts. Another horizontal row of holes (D2) is formed through the support plate (D) so that the conveyer unit 2 is screwed thereto. The conveyer unit 2 includes a conveyer body 21 attached to the support plate (D), a motor 22 activating a gearing 23, a rotating shaft 24 driven by the gearing 23, two front wheels 24 sleeved rigidly on the two ends of the rotating shaft 24, two rear wheels 26 mounted rotatably on the conveyer body 21, and two endless belts 27 running around the front wheels 24 and the rear wheels 26 so as to transfer the rotation of the front wheels 24 to the rear wheels 26. The bottom wall unit 15 is positioned between the conveyer belts 27, thereby permitting the superposed articles (A1) to be supported on the belts 27. The side wall units 11, 12 define a storage space therebetween in which the articles (A1) are placed. If necessary, the rear wall unit 16 can be moved forward or backward to a suitable position in which the distance between the front wall unit 13 and the rear wall unit 16 is slightly greater than the length of the articles (A1). In this way, the superposed articles (A1) can be arranged in a tier. The front wheels 24 are at a level slightly higher than that of the rear wheels 26, so as to prevent the lowermost article (A1) from unwanted forward movement. Entry of coin or coins activates the motor, thus driving the belts 27 to move the lowermost article (A1) forward away from the storage space. The conventional storage bin structure suffers from the following disadvantages:

(1) Because the rear wall unit 16 is positioned behind the articles (A1), it is difficult to adjust the position of the rear wall unit 16.

(2) When the articles (A1) are too heavy, the power of the motor cannot activate the belts 27, due to the fact that the front wheels 24 are at a level higher than that of the rear wheels 26.

SUMMARY OF THE INVENTION

An object of this invention is to provide a storage bin structure for an automatic vending machine in which it is easy to vary the length of the storage space for articles to be sold.

Another object of this invention is to provide a storage bin structure for an automatic vending machine in which it is easy to move the article to be sold.

According to this invention, a storage bin structure is used for superposed articles in an automatic vending machine and includes a front wall unit which can be moved to vary the volume of the storage space for the articles to be sold. A conveyer unit includes two motor-activated circular front wheels and two elliptical rear wheels. Two endless conveyer belts run around the front wheels and the rear wheels. When the belts are idle, the upper ends of the rear wheels are below those of the front wheels so as to prevent the lowermost one of the superposed articles from forward movement. When the belts circulate in response to entry of coin or coins, the rear wheels rotate so that the upper ends of the rear wheels are higher than those of the front wheels, thereby moving the articles forward.

BRIEF DESCRIPTION OF THE DRAWING

Other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
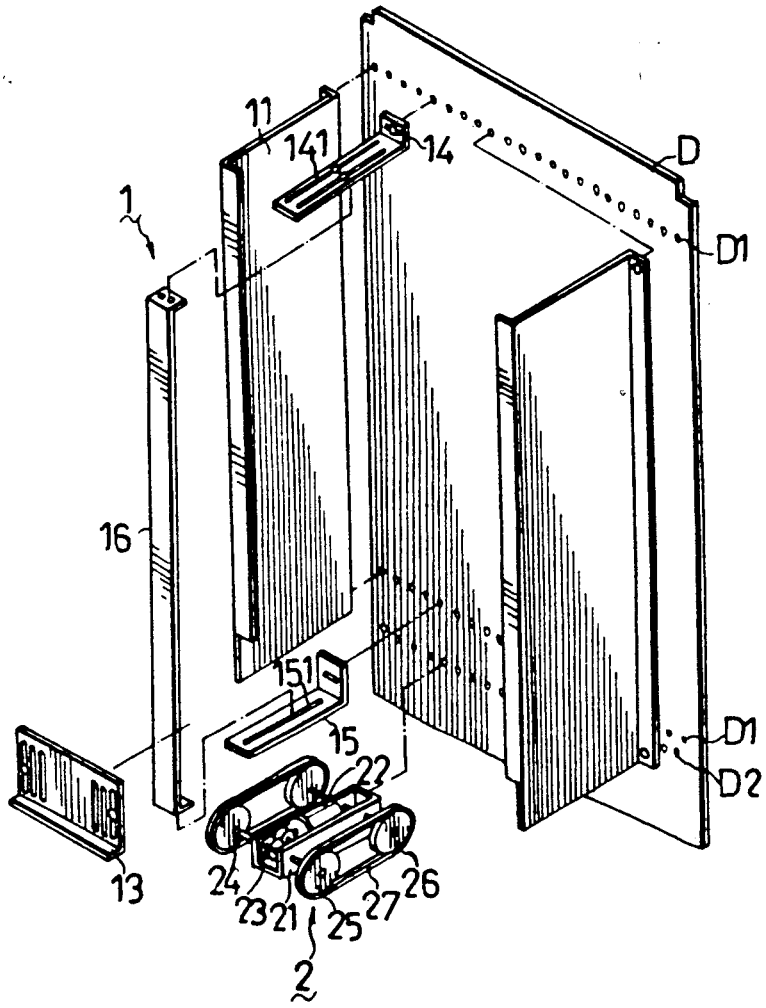
FIG 1 PRIOR ART
FIG. 1 is an exploded perspective view of a conventional storage bin structure for an automatic vending machine.
Figure 2:
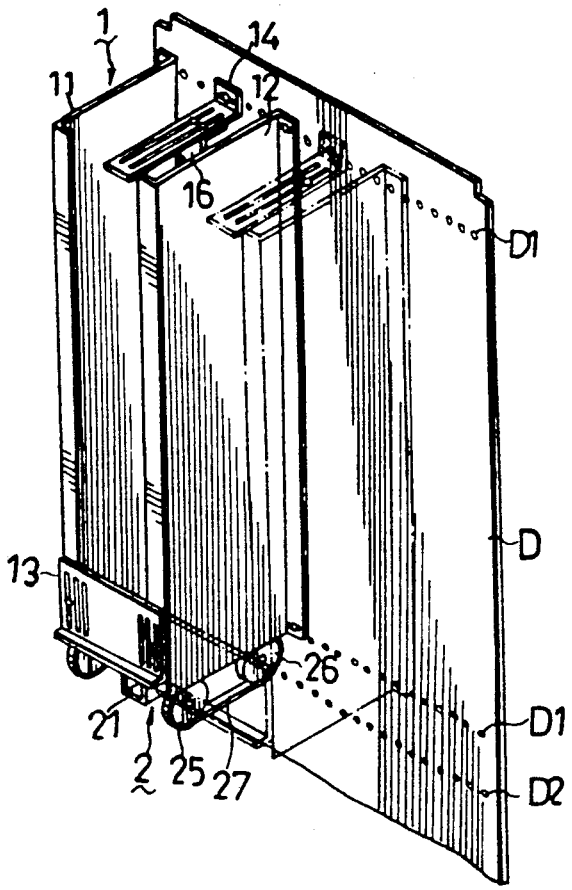
FIG 2 PRIOR ART
FIG. 2 is an assembled perspective view of the conventional storage bin structure.
Figure 3:
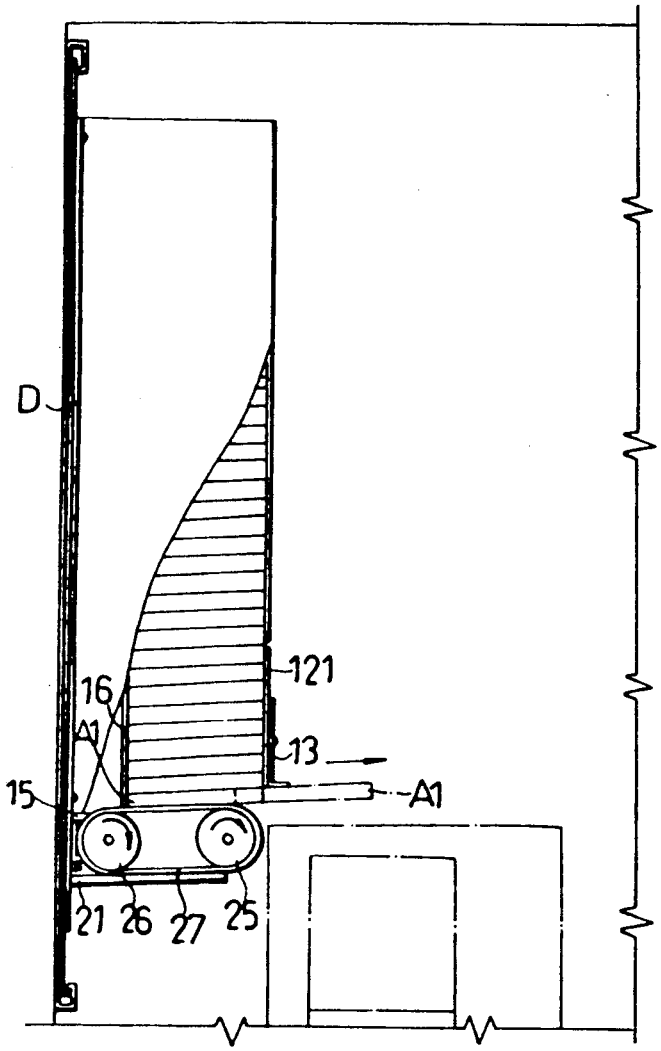
FIG 3 PRIOR ART
FIG. 3 is a schematic view illustrating the use of the conventional storage bin structure.
Figure 4:
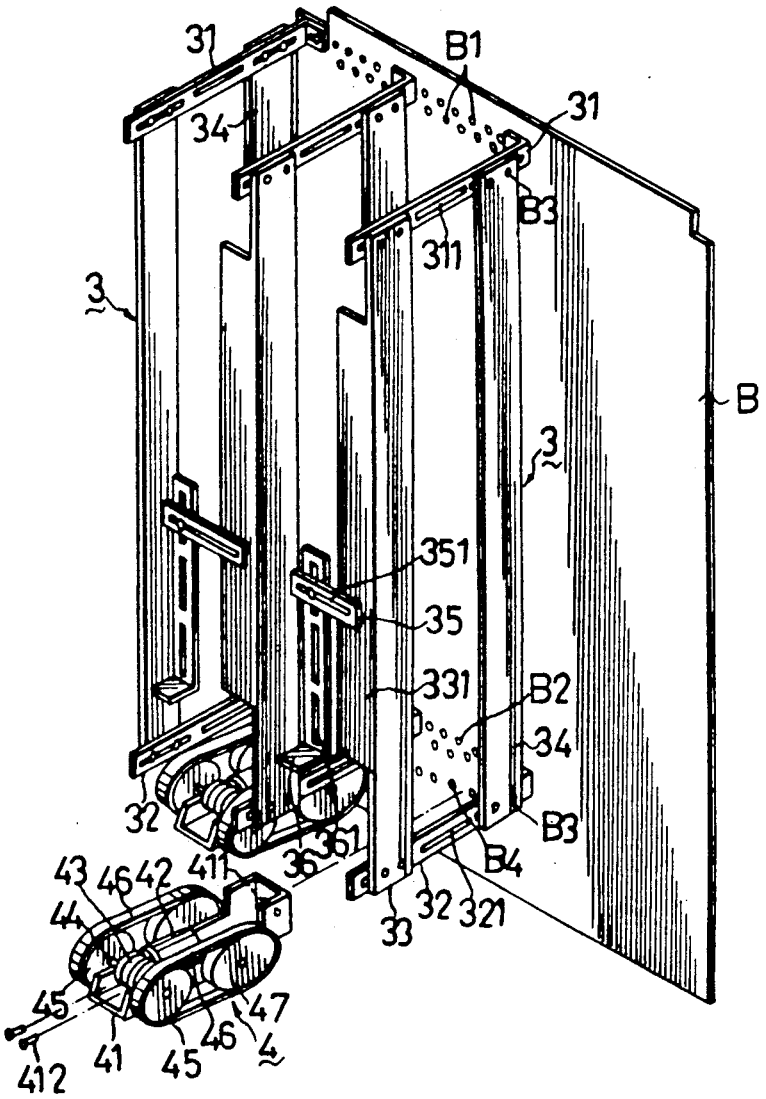
FIG. 4 is a partially exploded view of a storage bin structure for an automatic vending machine according to a first embodiment of this invention.

FIG. 4 shows two storage bin structures of this invention, each of which consists of a wall assembly 3 and a conveyer unit 4. The wall assembly 3 has two side wall units each of which includes an upper positioning rail 31, a lower positioning rail 32, a front blocking plate 33, a rear blocking plate 34, a horizontal connecting plate 35 and a vertical auxiliary plate 36. The two side wall units define a storage space therebetween.

A support plate (B) has two horizontal rows of upper holes (B1) so as to screw the upper positioning rails 31 thereto. Two horizontal rows of intermediate holes (B2) are formed through the support plate (B) under the upper holes (B1) so that the lower positioning rails 32 are screwed thereto. Each of the upper positioning rails 31 and the lower positioning rails 32 has lengthwise slide slots 311, 321. Side lock bolts (B3) extend through the upper and lower end portions of the front blocking plate 33 and the rear blocking plate 34 and through the slide slots 311, 321 of the upper and lower positioning rails 31, 32 to engage with side nuts, so as to lock the blocking plates 33, 34 on the upper and lower positioning rails 31, 32. The front blocking plate 33 has a side wall portion rectangular to the support plate (B) and a front wall portion 331 parallel to the support plate (B). The front wall portion 331 is integrally formed with the front end of the side wall portion of the front blocking plate 33 and constitutes a front wall unit. The support plate (B) acts as a rear wall unit for the storage space. The horizontal connecting plate 35 is mounted securely on the front wall portion of the front blocking plate 33 and has a lengthwise slide slot 351. The vertical auxiliary plate 36 has lengthwise slide slots 361. As illustrated, a front lock bolt is passed through the slide slot 351 of the connecting plate 35 and one of the slide slots 361 of the auxiliary plate 36 to engage with a front nut, so as to lock the auxiliary plate 36 on the connecting plate 35. Accordingly, the auxiliary plate 36 can be moved horizontally and vertically relative to the front blocking plate 33. It can be appreciated that it is easy to adjust the position of the front blocking plate 33 so as to vary the length of the storage space, due to the fact that the front blocking plate 33 is located at the foremost portion of the storage bin structure.

Figure 5:
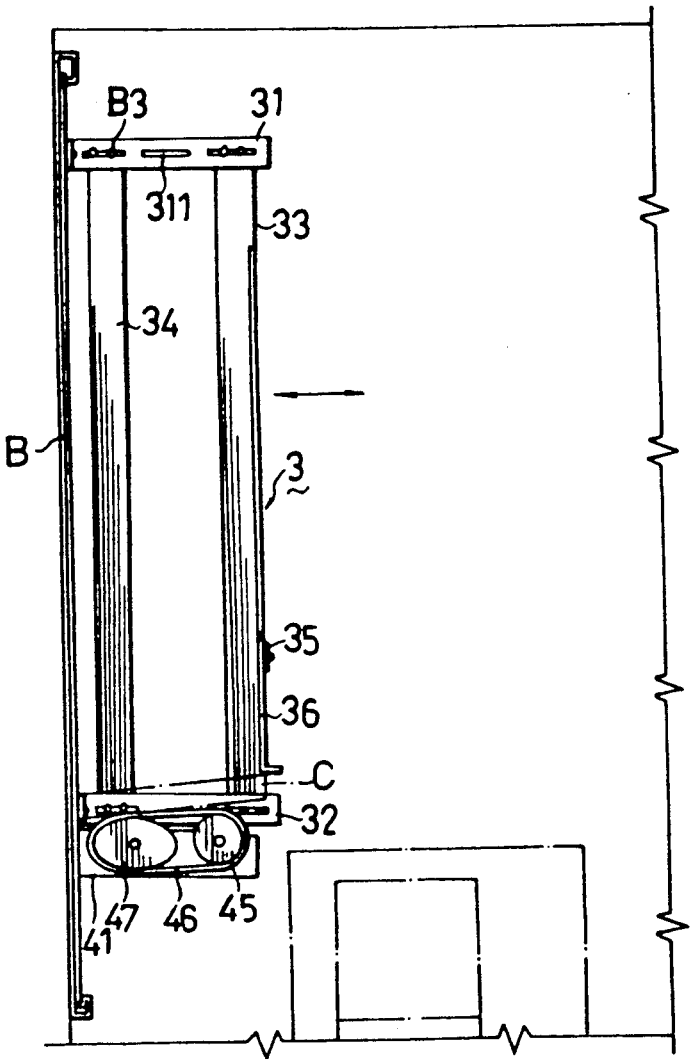
FIG. 5 is a schematic side view illustrating the storage bin structure according to the first embodiment of this invention.
Figure 6:
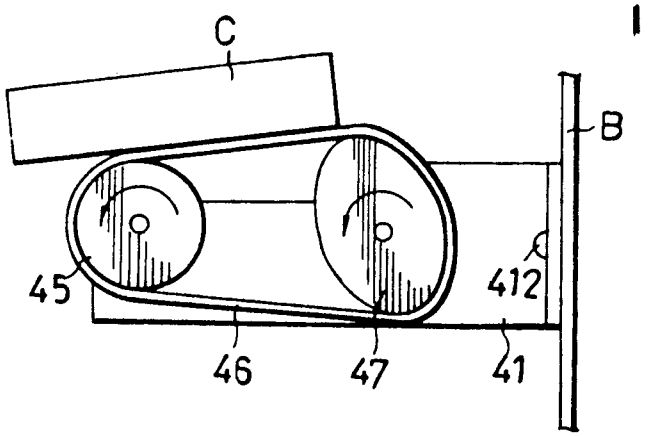
FIG. 6 is a schematic view illustrating the operation of the conveyer unit of the storage bin structure according to the first embodiment of this invention.

The support plate (B) further has a horizontal row of lower holes (B4) so as to screw the conveyer unit 4 thereto. The conveyer unit 4 includes a conveyer body 41 having a rear end wall with two holes 411 formed therethrough. Two lock bolts 412 are passed through the holes 411 of the conveyer body 41. A motor 42 and a gearing 43 are used to drive a rotating shaft 44 in a known manner. Two circular front wheels 45 are sleeved rigidly on the two ends of the rotating shaft 44. Two endless belts 46 transfer the rotation of the front wheels 45 to two elliptical rear wheels 47. The diameter of the front wheels 45 is greater than the length of the minor axis of the rear wheels 47, and less than the length of the major axis of the rear wheels 47. Accordingly, referring to FIG. 5, when the belt conveyer unit 4 is idle, the upper ends of the rear wheels 47 are below those of the front wheels 45, so as to prevent the articles (C) from unwanted forward movement. Referring to FIG. 6, when the belts 46 are activated to circulate so as to rotate the rear wheels 47, because the upper ends of the rear wheels 47 are higher than those of the front wheels 45, it is easy to move the lowermost one of the articles (C) forward.

Figure 7:
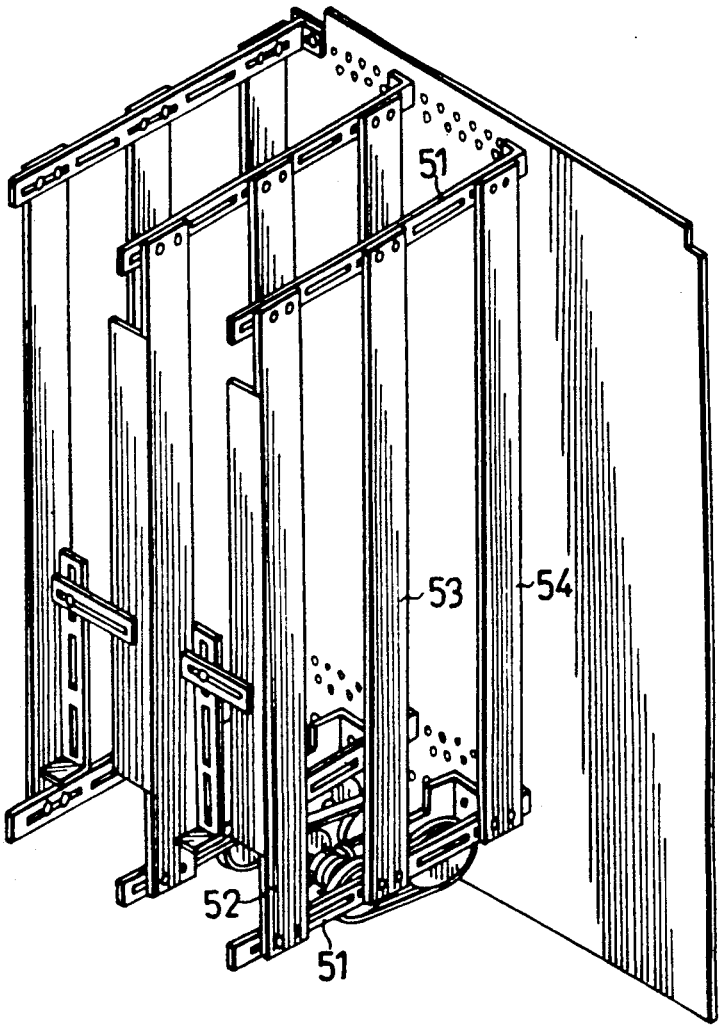
FIG. 7 is a perspective view showing the storage bin structure according to a second embodiment of this invention.

FIG. 7 shows a second embodiment of this invention. As illustrated, to increase the length of the storage space, the storage bin structure has modified side walls each of which includes increased-length upper and lower positioning rails 51, a front blocking plate 52, an intermediate blocking plate 53 and a rear blocking plate 54.

Figure 8:
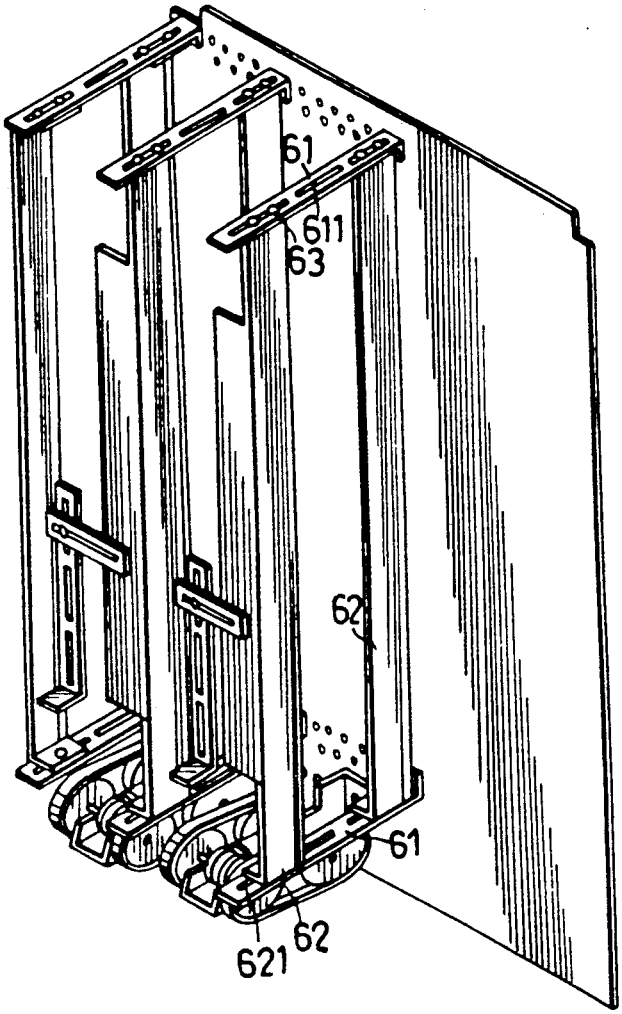
FIG. 8 is a perspective view showing the storage bin structure according to a third embodiment of this invention.

FIG. 8 shows a third embodiment of this invention, to enable the blocking plate to easily and stably slide on the positioning rails, the two end 621 portions of each of the blocking plates 62 are bent an angle of 90 degrees. Lock bolts 63 are passed through the end portions 621 of the blocking plates 62 and the slide slots 611 of the upper positioning rails 61 to engage with nuts (not shown).

Figure 9:
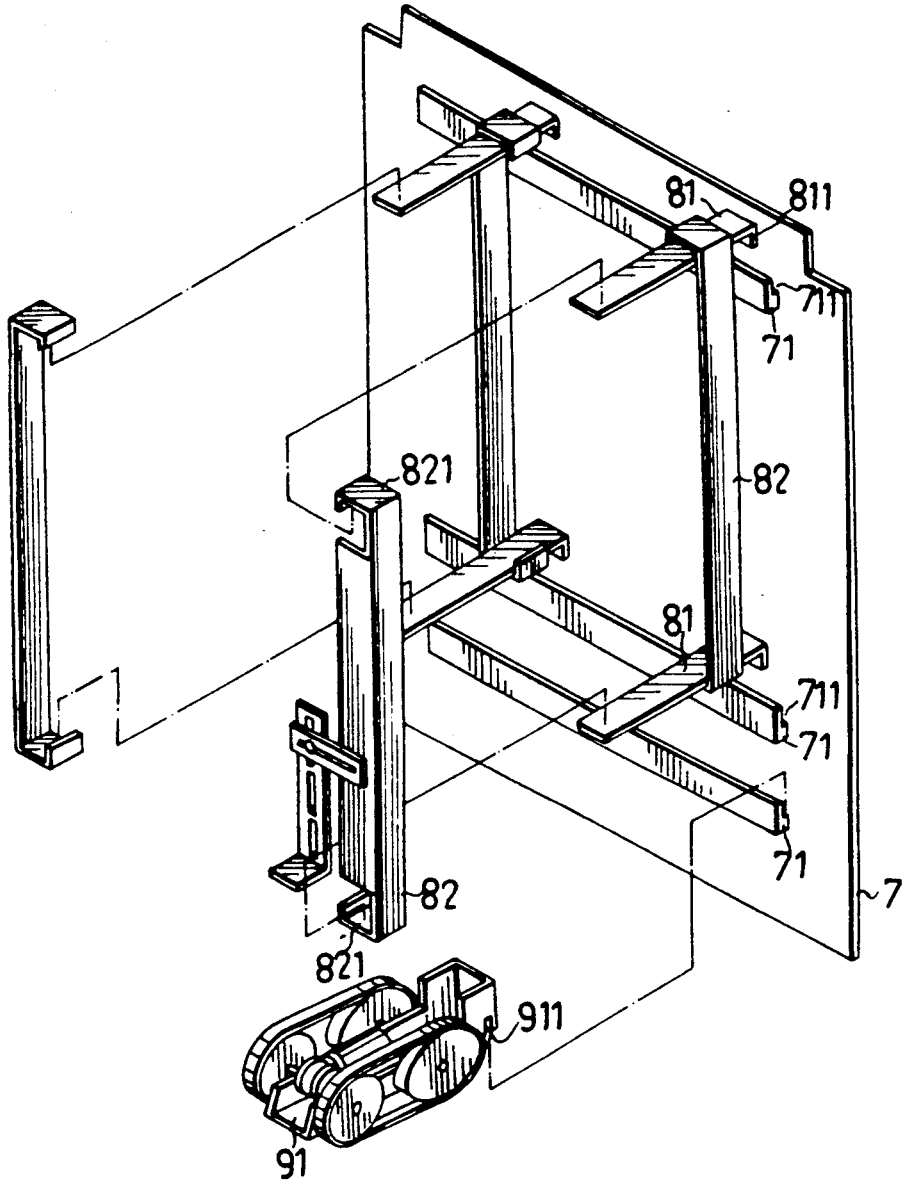
FIG. 9 is a partially exploded view showing the storage bin structure according to a fourth embodiment of this invention.

FIG. 9 shows a fourth embodiment of this invention. Unlike the first three embodiments, this embodiment includes three guide rails 71 of a L-shaped cross-section secured to a support plate 7 so as to define horizontal slide slots 711 between the support plate 7 and the upper portions of the guide rails 71. Positioning rails 81 and conveyer units 91 have downwardly extending rear end portions 811, 911 which are inserted into the horizontal slide slots 711 and which are clamped between the support plate 7 and the guide rails 71. Each of the blocking plates 82 is generally C-shaped and has a straight intermediate portion and two U-shaped end portions 821. With the U-shaped end portions 821, the blocking plates 82 can be hung on the upper positioning rails 81, while the lower positioning rails 81 can be hung on the blocking plates 82. In this way, it is easy to adjust the positions of the positioning rails 81, the blocking plates 82 and the conveyer unit 91.

With this invention thus explained, it is apparent that numerous modifications and variations can be made without departing from the scope and spirit of this invention. It is therefore intended that this invention be limited only as indicated in the appended claims.

I claim:

1. A storage bin structure for an automatic vending machine, including an upright support plate adapted to be fixed in said machine, two aligned side wall units mounted detachably on a surface of said support plate, a front blocking plate, including a front wall unit disposed on front end portions of said side wall units, a rear wall unit disposed on rear end portions of said side wall units and associated with said front wall unit and said side wall units to define a storage space for superposed articles to be sold, and a conveyor unit supporting said articles thereon and moving the lowermost one of said articles forward away from said storage space in response to entry of at least one coin into said machine, said front wall unit being positioned in front of said superposed articles so as to block said articles, other than the lowermost one, from forward movement, allowing only the lowermost one of said superposed articles to be passed out by said conveyor unit, characterized in that one of said side wall units includes an upper positioning rail fastened to said support plate, a lower positioning rail fastened to said support plate under said upper positioning rail, said front blocking plate having an upper end portion connected slidably to said upper positioning rail and a lower end portion connected slidably to said lower positioning rail, said front blocking plate having an upright side wall portion interconnecting said upper and lower positioning rails, and a front wall portion connected securely to said side wall portion in such a manner that said side wall portion is rectangular to said support plate, while said front wall portion is parallel to said support plate, said front wall portion constituting said front wall unit so as to prevent said articles from forward movement.

2. A storage bin structure as claimed in claim 1, wherein said conveyer unit includes a conveyer body attached to said support plate, a motor installed on said conveyer body and activated in response to the entry of said at least one coin, two aligned circular front wheels mounted rotatably on said conveyer body and activatable by said motor to rotate, two aligned elliptical rear wheels mounted rotatably on said conveyer body between said front wheels and said support plate, and two parallel endless conveyer belts running around said front wheels and said rear wheels, so as to transfer rotation of said front wheels to said rear wheels, said circular front wheel having a diameter greater than length of minor axis of said elliptical rear wheels and less than length of major axis of said elliptical rear wheels, whereby said conveyer belts can easily carry said articles away from said storage space due to the fact the diameter of said front wheels is less than the length of the major axis of said rear wheels, and the lowermost one of said articles cannot undesirably slide away from said storage space due to that fact that the diameter of said front wheels is greater than the length of the minor axis of said rear wheels.

3. A storage bin structure as claimed in claim 1, wherein each of said upper and lower positioning rails has a lengthwise slide slot formed therethrough, said front blocking plate having two holes respectively formed through the upper and lower end portions of said side wall portion, said side wall unit including two side lock bolts extending through said holes of said front blocking plate and said slide slots of said upper and lower positioning rails, and two side nuts engaged with said side lock bolts so as to lock said front blocking plate on said upper and lower positioning rails.

4. A storage bin structure as claimed in claim 1, wherein said side wall portion of said front blocking plate is generally C-shaped, in such a manner that said upper and lower end portions of said side wall portion are U-shaped, whereby said front blocking plate can be hung on said upper positioning rail and said lower positioning rail can be hung on said front blocking plate.

5. A storage bin structure as claimed in claim 1, wherein said front wall unit includes a horizontal connecting plate secured to said front wall portion of said front blocking portion in front of said storage space and having a lengthwise slide slot formed through said connecting plate, a vertical auxiliary plate with a lengthwise slide slot formed therethrough, a front lock bolt extending through said lengthwise slide slot of said connecting plate and said lengthwise slide slots of said auxiliary plate, and a front nut engaged with said front lock bolt, whereby said auxiliary plate can be moved vertically and horizontally relative to said front blocking plate by loosening said front nut from said front lock bolt.

6. A storage bin structure as claimed in claim 1, wherein said support plate includes two parallel horizontal guide rails of a L-shaped cross-section which are mounted securely on said support plate, so as to define two horizontal slide slots between said support plate and upper portions of said guide rails, each of said upper and lower positioning rail shaving a downwardly extending rear end portion which is inserted into said horizontal slide slot and which is clamped between said guide rail and said support plate whereby positions of said upper and lower positioning rails relative to said support plate can be adjusted.

* * * * *